US009856890B2

(12) United States Patent
Tsutsui et al.

(10) Patent No.: US 9,856,890 B2
(45) Date of Patent: Jan. 2, 2018

(54) PUMP APPARATUS AND HYDRAULIC ACTUATOR

(71) Applicant: Showa Corporation, Gyoda-shi (JP)

(72) Inventors: Hayato Tsutsui, Haga-gun (JP); Kazuhiko Sadakata, Haga-gun (JP); Atsushi Kagawa, Haga-gun (JP)

(73) Assignee: SHOWA CORPORATION, Gyoda-shi (JP)

( * ) Notice: Subject to any disclaimer, the term of this patent is extended or adjusted under 35 U.S.C. 154(b) by 426 days.

(21) Appl. No.: 14/491,075

(22) Filed: Sep. 19, 2014

(65) Prior Publication Data

US 2015/0275928 A1 Oct. 1, 2015

(30) Foreign Application Priority Data

Mar. 25, 2014 (JP) ..... 2014-062718

(51) Int. Cl.
*F15B 13/01* (2006.01)
*F15B 11/024* (2006.01)
(Continued)

(52) U.S. Cl.
CPC ..... *F15B 11/024* (2013.01); *F04B 5/02* (2013.01); *F04B 53/10* (2013.01); *F04C 2/18* (2013.01); *F04C 15/068* (2013.01); *F15B 13/027* (2013.01); *F15B 15/18* (2013.01); *B63H 20/10* (2013.01); *F15B 13/01* (2013.01); *F15B 2211/205* (2013.01); *F15B 2211/20515* (2013.01); *F15B 2211/20561* (2013.01); *F15B 2211/27* (2013.01); *F15B 2211/30* (2013.01); *F15B 2211/3051* (2013.01); *F15B 2211/50518* (2013.01); *F15B 2211/50554* (2013.01);
(Continued)

(58) Field of Classification Search
CPC ..... F15B 13/01
See application file for complete search history.

(56) References Cited

U.S. PATENT DOCUMENTS 4,192,338 A * 3/1980 Gerulis ..... F15B 13/01 137/106
5,481,871 A * 1/1996 McFadyen ..... B63H 25/12 137/106
(Continued)

FOREIGN PATENT DOCUMENTS

JP 09-011987 A 1/1997
JP 2003-097504 A 4/2003
JP 2006-132604 A 5/2006

OTHER PUBLICATIONS

Office Action dated Jul. 11, 2017 for the corresponding Japanese Patent Application No. 2014-062718.

*Primary Examiner* — F. Daniel Lopez
(74) *Attorney, Agent, or Firm* — Leason Ellis LLP

(57) ABSTRACT

A pump apparatus includes: a pump that ejects a hydraulic fluid; and a selector valve that switches a direction of a flow of the hydraulic fluid to be supplied to one of a first chamber and a second chamber of a cylinder apparatus, which is internally partitioned by a piston into the first chamber extending during an extending stroke of the cylinder apparatus, and the second chamber extending during a shortening stroke of the cylinder apparatus, and the selective valve has, at a channel connected to the second chamber, an orifice that is narrower than a channel connected to the first chamber.

5 Claims, 11 Drawing Sheets

(51) Int. Cl.

| | |
|---|---|
| ***F04B 5/02*** | (2006.01) |
| ***F04B 53/10*** | (2006.01) |
| ***F15B 13/02*** | (2006.01) |
| ***F15B 15/18*** | (2006.01) |
| ***F04C 2/18*** | (2006.01) |
| ***F04C 15/06*** | (2006.01) |
| *B63H 20/10* | (2006.01) |

(52) U.S. Cl.
CPC .... *F15B 2211/511* (2013.01); *F15B 2211/565* (2013.01); *F15B 2211/7052* (2013.01)

(56) References Cited

U.S. PATENT DOCUMENTS 6,273,770 B1 * 8/2001 Saito ..... B63H 20/10
440/61 D
6,422,127 B1 * 7/2002 Huber ..... B62D 25/12
137/516.27

* cited by examiner

PUMP APPARATUS AND HYDRAULIC ACTUATOR

CROSS-REFERENCE TO RELATED APPLICATIONS

This application is based on and claims priority under 35 U.S.C. 119 from Japanese Patent Application No. 2014-062718 filed on Mar. 25, 2014, the entire content of which is incorporated herein by reference.

BACKGROUND OF THE INVENTION

1. Field of the Invention

The present invention relates to a pump apparatus and a hydraulic actuator.

2. Description of the Related Art

A hydraulic actuator used to, for example, change the inclination of an outboard motor with respect to a hull is provided with a selector valve in a channel between a pump and a cylinder apparatus internally partitioned into a lower chamber (first chamber) and an upper chamber (second chamber) by the piston; the selector valve directs a flow of a hydraulic fluid to the lower chamber or the upper chamber in a switchable manner. The selector valve includes an open valve located on a side of the selector valve which leads to the lower chamber and an open valve located on a side of the selector valve which leads to the upper chamber; the open valves are interlocked with each other. Each of the open valves is a combination of an actuation valve and a check valve which slide in a valve chamber.

The selector valve operates as follows. When a hydraulic fluid flows into a valve chamber for the open valve located on the side of the selector valve which leads to the lower chamber, the lower chamber-side check valve is opened under the pressure of the hydraulic fluid to cause the hydraulic fluid to flow to the lower chamber. In parallel with the operation of the check valve, the lower chamber-side actuation valve pressed by the inflow of the hydraulic fluid is displaced inside the valve chamber. The pressure of the displaced actuation valve displaces, via a communication path, the actuation valve in the open valve located on the side of the selector valve which leads to the upper chamber. Then, the displaced upper chamber-side actuation valve pushes and opens the upper chamber-side check valve to return the hydraulic fluid from the upper chamber to the pump. This operation extends the shortened cylinder apparatus to increase the inclination of the outboard motor.

On the other hand, when the hydraulic fluid flows into the valve chamber for the open valve located on a side of the selector valve which leads to the upper chamber, an operation opposite to the above-described operation is performed to feed the hydraulic fluid to the upper chamber, while returning the hydraulic fluid from the lower chamber to the pump. This operation shortens the extended cylinder apparatus to reduce the inclination of the outboard motor.

If the outboard motor has a weight larger than an expected value or air is mixed into a channel between the upper chamber in the cylinder apparatus and the check valve located on the side of the selector valve which leads to the upper chamber, when the tilted-up outboard motor is lowered, the outboard motor may move jerkily. This is because, as the cylinder apparatus shortens, the pressure in the above-described channel lowers excessively to prevent the upper chamber-side actuation valve from maintaining a displaced state, causing the check valve located on the side leading to the lower chamber to be repeatedly opened and closed.

Thus, to restrain this jerky motion, a narrowed orifice is provided in the channel (see, for example, Japanese Patent Application Laid-open No. H9-11987).

The above-described channel is formed in a manifold (housing) via which the pump and the cylinder apparatus are connected together, and thus, a machining operation needs to be performed on the manifold in order to form the narrowed orifice.

With the foregoing in view, it is an object of the present invention to provide a pump apparatus and a hydraulic actuator which allows jerky motion of the hydraulic actuator to be suppressed without the need to add a machining operation for providing a narrowed orifice.

SUMMARY OF THE INVENTION

The present invention is a pump apparatus integrally including: a pump that ejects a hydraulic fluid; and a selector valve that switches a direction of a flow of the hydraulic fluid to be supplied to one of a first chamber and a second chamber of a cylinder apparatus, which is internally partitioned by a piston into the first chamber extending during an extending stroke of the cylinder apparatus, and the second chamber extending during a shortening stroke of the cylinder apparatus, wherein the selective valve has, at a channel connected to the second chamber, an orifice that is narrower than a channel connected to the first chamber. In the pump apparatus according to the present invention, the selector valve includes an actuation valve and a check valve. The orifice may be formed as a part of a channel between the actuation valve and the check valve.

In the pump apparatus according to the present invention, a case housing the pump may include a first case and a second case which are laid on top of each other, the first case may include a check valve chamber in which a main body of the check valve is housed, the second case may include an actuation valve chamber in which a main body of the actuation valve is housed, and the orifice may be formed as a part of a channel through which the check valve chamber and the actuation valve chamber communicate with each other.

The present invention is a hydraulic actuator including a cylinder apparatus internally partitioned by a piston into a first chamber extending during a stroke of the piston for extending the cylinder apparatus and a second chamber extending during a stroke of the piston for shortening the cylinder apparatus, and a pump apparatus integrally having a pump that ejects a hydraulic fluid and a selector valve that switches a direction of a flow of the hydraulic fluid to be supplied to one of the first chamber and the second chamber, the selective valve comprising, at a channel connected to the second chamber, an orifice that is narrower than a channel connected to the first chamber.

The pump apparatus according to the present invention allows jerky motion of the hydraulic actuator to be suppressed without the need to add a machining operation for providing the orifice.

The hydraulic actuator according to the present invention can be restrained from moving jerkily without the need to add a machining operation for providing the orifice.

EXPLANATION OF REFERENCE NUMERALS

22 First case
22*m* First check valve chamber
22*n* Second check valve chamber
22*p*, 22*q* Opening portion
51 Selector valve
51*a* First open valve
51*b* First actuation valve
51*e* First check valve
51*f* First valve chamber
52*a* Second open valve
52*b* Second actuation valve
52*e* Second check valve
52*f* Second valve chamber

DETAILED DESCRIPTION OF THE INVENTION

Embodiments of the present invention will be described below with reference to the attached drawings.

Embodiment 1

Figure 1:
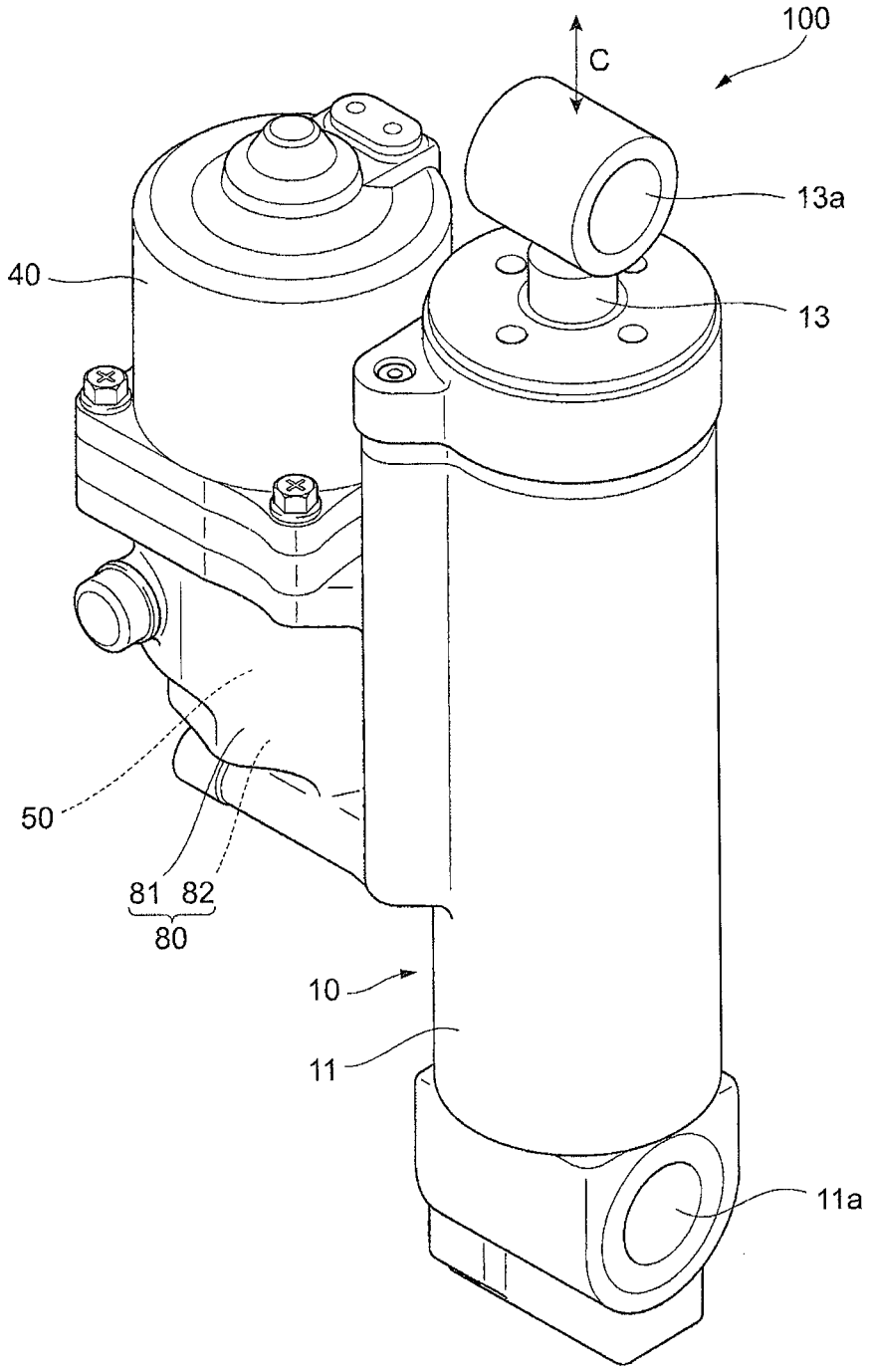
FIG. 1 is a perspective view showing the appearance of a trim/tilt apparatus including a pump apparatus according to an embodiment of the present invention.
Figure 2:
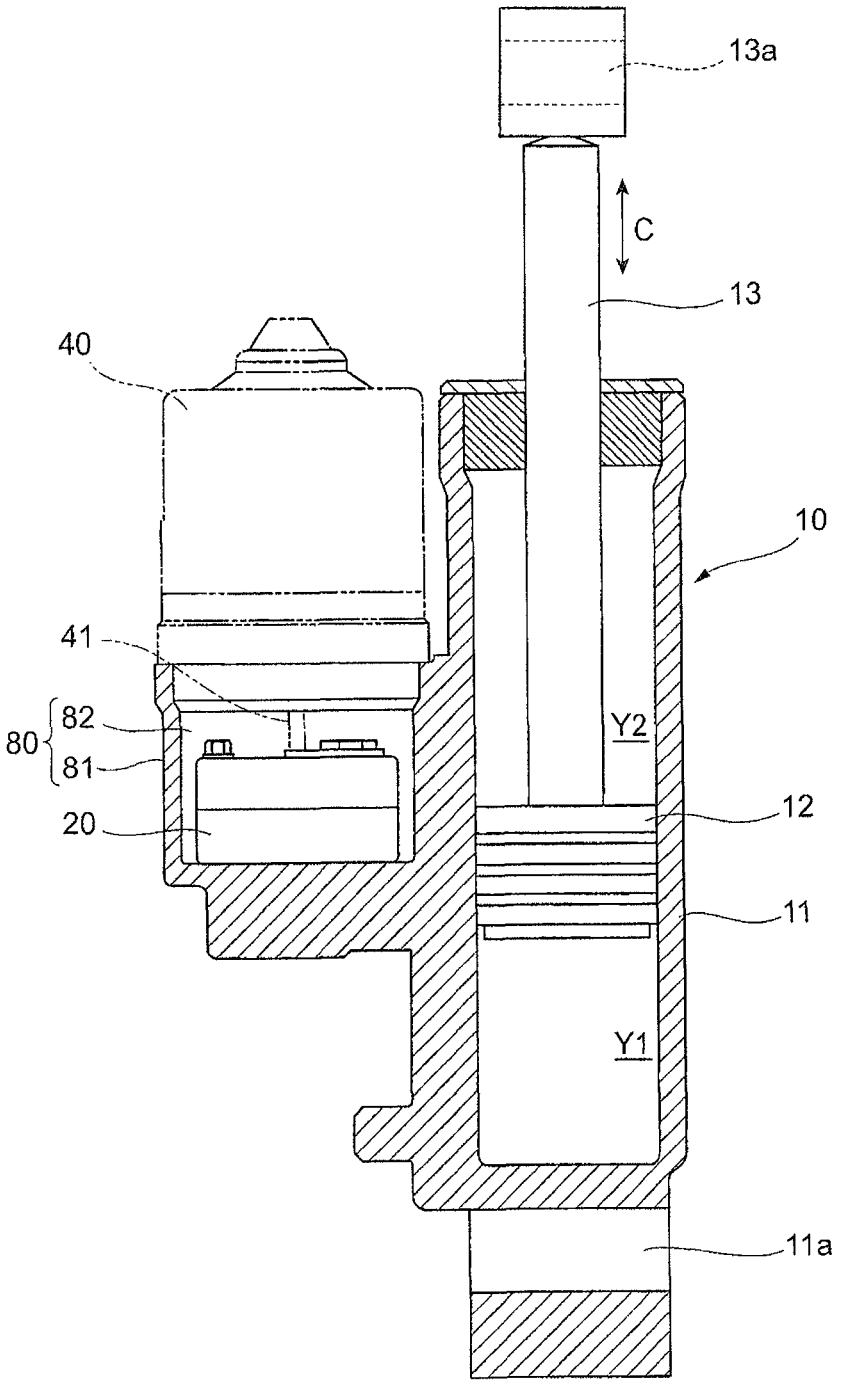
FIG. 2 is a cross-sectional view of an important part of the trim/tilt apparatus.
Figure 3:
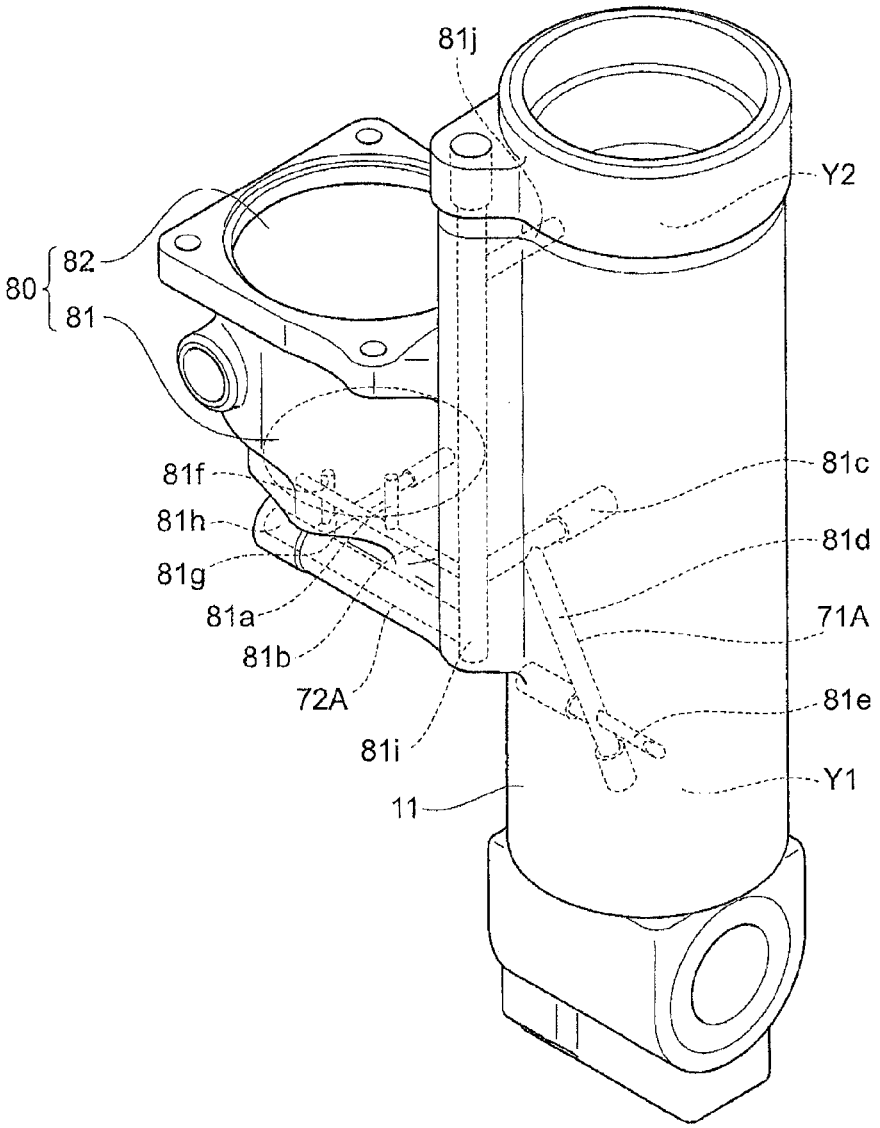
FIG. 3 is a perspective view showing a housing and a cylinder of the trim/tilt apparatus.

FIG. 1 is a perspective view showing the appearance of a trim/tilt apparatus 100 (an example of a hydraulic actuator) including a pump apparatus 20 according to an embodiment (Embodiment 1) of the present invention. FIG. 2 is a cross-sectional view of an important part of the trim/tilt apparatus 100. FIG. 3 is a perspective view showing a housing 81 and a cylinder 11 in the trim/tilt apparatus 100.

<General Configuration of the Trim/Tilt Apparatus 100>

As shown in FIG. 1 and FIG. 2, the trim/tilt apparatus 100 includes a cylinder apparatus 10 that is extended and shortened by supply and discharge of oil, an example of a hydraulic fluid, a pump apparatus 20 that delivers oil, a motor 40 that drives the pump apparatus 20, and a tank 80 in which oil is stored.

(Cylinder Apparatus 10)

As shown in FIG. 2, the cylinder apparatus 10 includes a cylinder 11 extending in the direction of an axis C, a piston 12 arranged inside the cylinder 11 and sliding along the direction of the axis C in the cylinder 11, and a piston rod 13 with the piston 12 fixed thereto at one end thereof, the piston rod 13 being displaced integrally with the piston 12 and moving forward and backward in the direction of the axis C with respect to the cylinder 11.

The cylinder apparatus 10 is internally partitioned into a first chamber Y1 and a second chamber Y2 by the piston 12. Supply of oil to the first chamber Y1 extends the cylinder apparatus 10. Supply of oil to the second chamber Y2 shortens the cylinder apparatus 10. In this case, extension of the cylinder apparatus 10 allows oil to be discharged from the second chamber Y2. Shortening of the cylinder apparatus 10 allows oil to be discharged from the first chamber Y1.

The cylinder 11 includes a pin hole 11*a* formed at a lower end, in FIG. 2, of the cylinder 11 and into which a pin (not shown in the drawings) for connection to a stern bracket 340 of a ship propulsion machine 300 described below (see FIG. 4 described below) is inserted. On the other hand, the piston rod 13 includes a pin hole 13*a* formed at an upper end, in FIG. 2, of the piston rod 13 and into which a pin (not shown in the drawings) for connection to a swivel case 330 in the ship propulsion machine 300 described below (see FIG. 4 described below) is inserted.

(Tank 80)

The tank 80 includes a housing 81 and a tank chamber 82 that is a space enclosed by the housing 81. The housing 81 is formed integrally with the cylinder 11. As shown in FIG. 3, the housing 81 and the cylinder 11 include only two channels—a part of a cylinder-side first chamber-side channel 71A and a part of a cylinder-side second chamber-side channel 72A—as channels for oil connecting the pump apparatus 20 to the first chamber Y1 and the second chamber Y2 in the cylinder apparatus 10.

The cylinder-side first chamber-side channel 71A is partly formed by connecting together a housing first hole 81*a*, a housing second hole 81*b*, a housing third hole 81*c*, a cylinder first hole 81*d*, and a cylinder second hole 81*e*.

The housing first hole 81*a* is formed to extend downward from a bottom surface of the housing 81 so as not to penetrate a bottom portion of the housing 81. The housing second hole 81*b* is formed to extend horizontally from a side surface of the bottom portion of the housing 81 toward the cylinder 11 so as to cross the housing first hole 81*a*. The housing third hole 81*c* is formed to extend horizontally from a side surface of a boundary portion between the housing 81 and the cylinder 11 so as to cross the housing second hole 81*b* at right angles. The cylinder first hole 81*d* is formed to extend obliquely upward from a side surface of the cylinder 11 so as to cross the housing third hole 81*c* at right angles. The cylinder second hole 81*e* is formed to extend horizontally from the side surface of the cylinder 11 so as to cross the cylinder first hole 81*d* and to open into the first chamber Y1.

The housing second hole 81*b*, the housing third hole 81*c*, the cylinder first hole 81*d*, and the cylinder second hole 81*e* are closed with plugs or the like (not shown in the drawings) at a portion of each hole which faces the outside of the housing 81 and at a portion of each hole which faces the outside of the cylinder 11.

The cylinder-side second chamber-side channel 72A is partly formed by connecting together a housing fourth hole 81*f*, a housing fifth hole 81*g*, a housing sixth hole 81*h*, a cylinder third hole 81*i*, and a cylinder fourth hole 81*j*.

The housing fourth hole 81*f* is formed to extend downward through the bottom surface of the housing 81 so as not to penetrate the bottom portion of the housing 81. The housing fifth hole 81*g* is formed to extend horizontally from the side surface of the bottom portion of the housing 81 so as to cross the housing fourth hole 81*f*. The housing sixth hole 81*h* is formed to extend horizontally from the side surface of the bottom portion of the housing 81 toward the cylinder 11 so as to cross the housing fifth hole 81*g* at right angles. The cylinder third hole 81*i* is formed to extend downward from an upper surface of the cylinder 11 so as to cross the housing sixth hole 81*h* at right angles. The cylinder fourth hole 81*j* is formed to extend obliquely downward from the second chamber Y2 so as to cross the cylinder third hole 81*i*.

The housing fifth hole 81*g*, the housing sixth hole 81*h*, and the cylinder third hole 81*i* are closed with plugs or the like (not shown in the drawings) at a portion of each hole which faces the outside of the housing 81 and at a portion of each hole which faces the outside of the cylinder 11.

The pump apparatus 20 is arranged at a bottom portion of the tank chamber 82. Oil is stored in the tank chamber 82, and thus, the pump apparatus 20 is immersed in the oil.

(Motor 40)

The motor 40 is placed on the housing 81 so as to close an upper opening in the tank chamber 82 in a liquid-tight manner and is fixed to the housing 81. In this state, a drive shaft 41 (see FIG. 2) of the motor 40 is coupled to a gear pump 21 (see FIG. 7 described below) of the pump apparatus 20 arranged in the tank chamber 82 so that the gear pump 21 can be driven using the motor 40.

The pump apparatus 20 will be described below.

Figure 4:
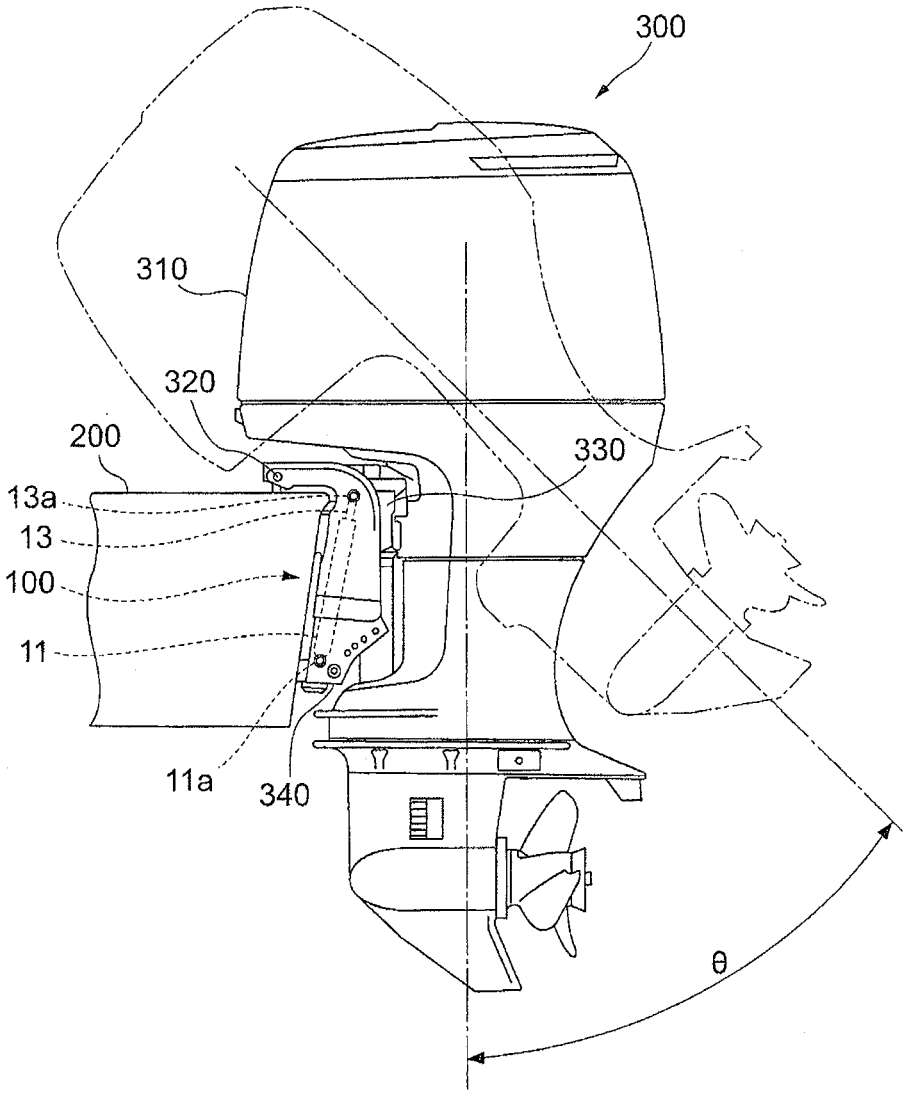
FIG. 4 is a schematic diagram showing arrangement of a hull and a ship propulsion machine for which the trim/tilt apparatus is used, as viewed from a side of the trim/tilt apparatus.

FIG. 4 is a schematic diagram showing arrangement of a hull 200 and a ship propulsion machine 300 for which a trim/tilt apparatus 100 is used, as viewed from a side of the trim/tilt apparatus 100.

As shown in FIG. 4, the ship propulsion machine 300 includes a ship propulsion machine main body 310 that generates a propulsion force. The ship propulsion machine main body 310 has a swivel shaft (not shown in the drawings) provided in the vertical direction (up-down direction), a horizontal shaft 320 provided in the horizontal direction with respect to a water surface, the swivel case 330 in which the swivel shaft is rotationally movably housed, and the stern bracket 340 that connects the swivel case 330 to the hull 200.

The swivel case 330 is coupled to the pin hole 11*a* in the cylinder 11 of the trim/tilt apparatus 100 using a pin. The stern bracket 340 is coupled to a pin hole 13*a* in the piston rod 13 using a pin. Extension and shortening of the cylinder apparatus 10 changes the distance between the stern bracket 340 and the swivel case 330. This in turn changes the inclination θ of the ship propulsion machine 300 to the hull 200.

<Hydraulic Circuit for the Trim/Tilt Apparatus 100>

Figure 5:
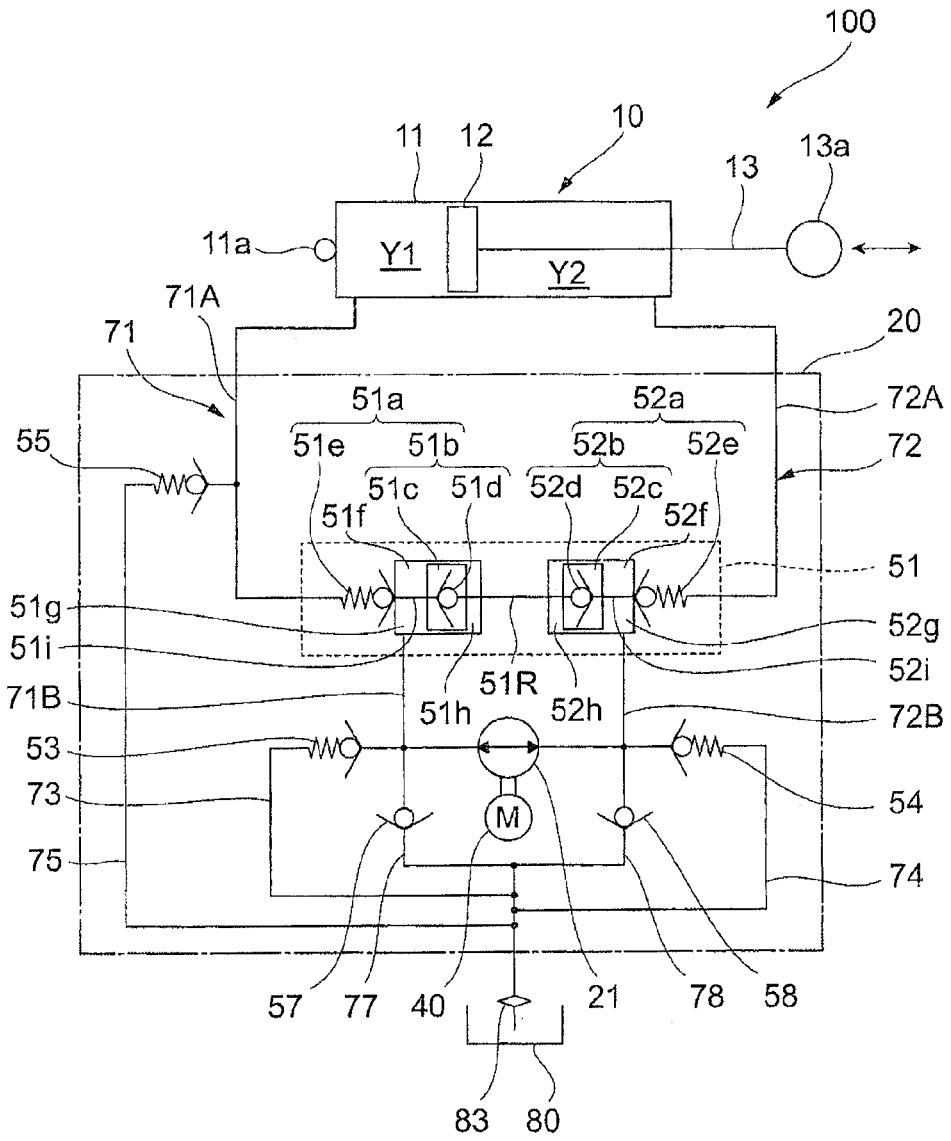
FIG. 5 is a diagram showing a hydraulic circuit for the trim/tilt apparatus.

FIG. 5 is a hydraulic circuit for the trim/tilt apparatus 100. First, the hydraulic circuit for the trim/tilt apparatus 100 will be described with reference to FIG. 5.

The cylinder apparatus 10 is internally partitioned into the first chamber Y1 and the second chamber Y2 by the piston 12. Supply of oil to the first chamber Y1 extends the cylinder apparatus 10. Supply of oil to the second chamber Y2 shortens the cylinder apparatus 10. In this case, extension of the cylinder apparatus 10 allows oil to be discharged from the second chamber Y2. Shortening of the cylinder apparatus 10 allows oil to be discharged from the first chamber Y1.

The hydraulic circuit is a circuit that controls the supply and discharge of oil to and from the first chamber Y1 and the second chamber Y2.

A first chamber-side channel 71 leading to the first chamber Y1 and a second chamber-side channel 72 leading to the second chamber Y2 are formed between the cylinder apparatus 10 and a gear pump 21 provided in the pump apparatus 20 and including a pair of gears. A selector valve 51 is arranged across the first chamber-side channel 71 and the second chamber-side channel 72.

(Selector Valve 51)

The selector valve 51 switches the direction of the flow of oil toward the first chamber Y1 or toward the second chamber Y2. The selector valve 51 includes a first open valve 51*a* provided on the first chamber-side channel 71 and a second open valve 52*a* provided on the second chamber-side channel 72.

The first open valve 51*a* includes a first actuation valve 51*b* and a first check valve 51*e* (check valve main body). The first actuation valve 51*b* includes a spool 51*c* (actuation valve main body) that slides through a first valve chamber 51*f* (actuation valve chamber), and an actuation valve ball 51*d* (actuation valve main body) incorporated in the spool 51*c*. The first valve chamber 51*f* is partitioned, by the spool 51*c*, into a main oil chamber 51*g* arranged to provide communication with the first check valve 51*e* and an opposite sub oil chamber 51*h*. In the first chamber-side channel 71, a pump-side first chamber-side channel 71B leading from the gear pump 21 to the first open valve 51*a* is connected to the main oil chamber 51*g* in the first open valve 51*a*.

Figure 9:
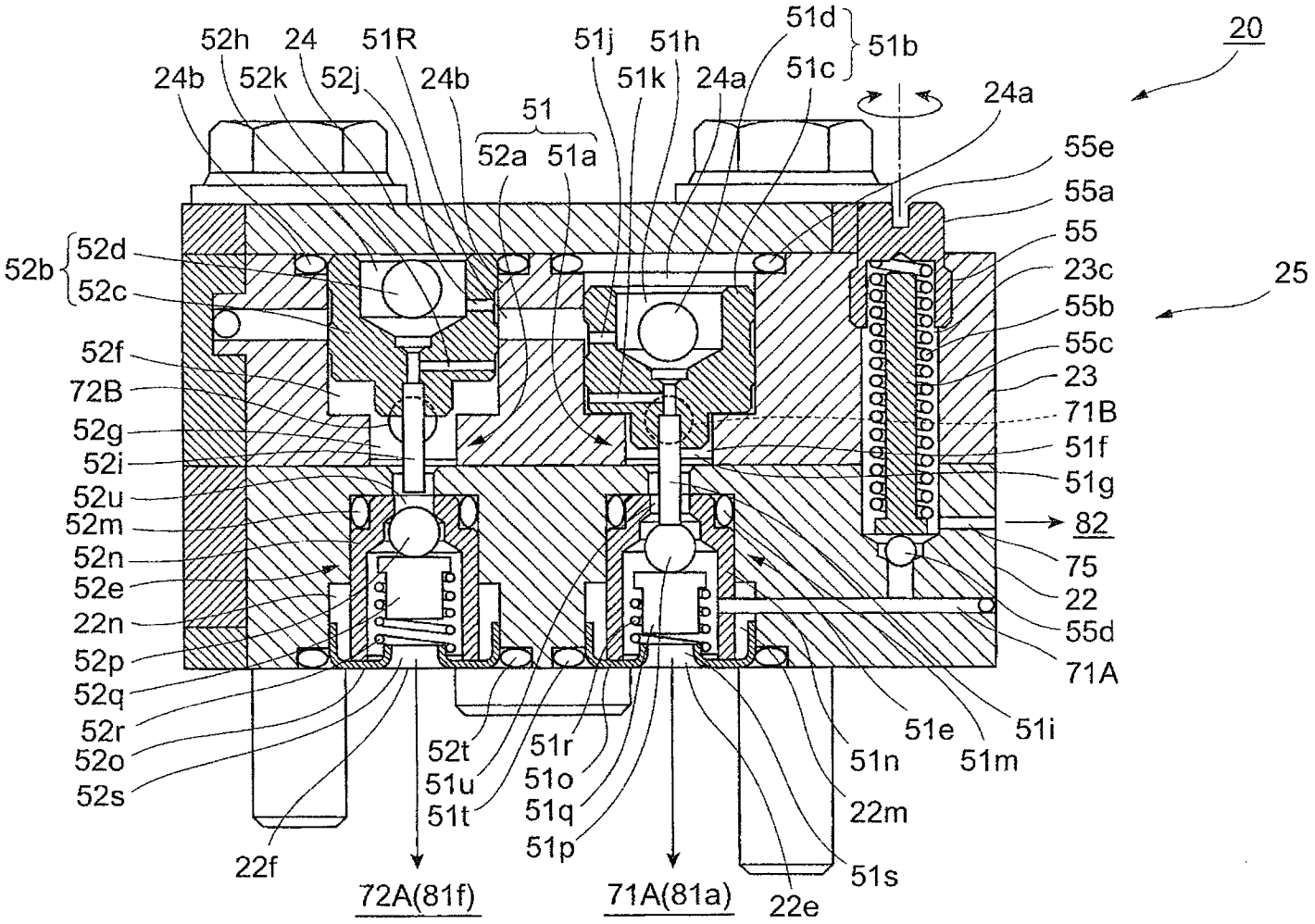
FIG. 9 is a cross-sectional view taken along line IX-IX in FIG. 6 and showing a plane including a first open valve, a second open valve, and a third relief valve of a selector valve.

The spool 51*c* is provided with a projection 51*i* which projects toward the first check valve 51*e* and which pushes the first check valve 51*e* when the spool 51*c* is displaced toward the first check valve 51*e* side. Furthermore, the spool 51*c* includes: a first hole 51*j* to allow the main oil chamber 51*g* and the sub oil chamber 51*h* to communicate with each other; and a second hole 51*k* to allow the sub oil chamber 51*h* and a communication path 51R described below to communicate with each other, as shown in FIG. 9 described below.

The actuation valve ball 51*d* opens the first hole 51*j* when the pressure in the main oil chamber 51*g* is higher than the pressure in the sub oil chamber 51*h*. The actuation valve ball 51*d* closes the first hole 51*j* when the pressure in the main oil chamber 51*g* is lower than the pressure in the sub oil chamber 51*h*.

The second open valve 52*a* is configured similarly to the first open valve 51*a*. That is, the second open valve 52*a* includes a second actuation valve 52*b* and a second check valve 52*e* (check valve main body). The second actuation valve 52*b* includes a spool 52*c* (actuation valve main body) which slides through a second valve chamber 52*f* (actuation valve chamber) and which is provided with a projection 52*i* that pushes the second check valve 52*e* and in which a first hole 52*j* and a second hole 52*k* are formed, and an actuation valve ball 52*d* (actuation valve main body) incorporated in the spool 52*c* to open and close the first hole 52*j* in accordance with the pressure magnitude relation between a main oil chamber 52*g* and a sub oil chamber 52*h*. The second valve chamber 52*f* is partitioned, by the spool 52*c*, into the main oil chamber 52*g* arranged to provide communication with the second check valve 52*e* and the opposite sub oil chamber 52*h*. In the second chamber-side channel 72, a pump-side second chamber-side channel 72B leading from the gear pump 21 to the second open valve 52*a* is connected to the main oil chamber 52*g* in the second open valve 52*a*.

The sub oil chamber 51*h* in the first open valve 51*a* and the sub oil chamber 52*h* in the second open valve 52*a* are in communication with each other via the communication path 51R.

In this case, for example, the gear pump 21 is rotated forward to feed oil from the gear pump 21 to the pump-side first chamber-side channel 71B, and the oil then flows into the main oil chamber 51*g* in the first open valve 51*a*. An increase in the pressure in the main oil chamber 51*g* causes the first check valve 51*e* to be opened to allow the oil to flow from the first open valve 51*a* in the first chamber-side channel 71 to the cylinder-side first chamber-side channel 71A leading from the first open valve 51*a* to the first chamber Y1 in the cylinder apparatus 10. The oil flows into the first chamber Y1 in the cylinder apparatus 10 to push the piston 12 toward the second chamber Y2.

Furthermore, the oil having flown into the main oil chamber 51*g* in the first open valve 51*a* opens the actuation valve ball 51*d* in the spool 51*c* in the first actuation valve 51*b* and then flows into the sub oil chamber 51*h*. Then, the oil having flown into the sub oil chamber 51*h* passes through the communication path 51R and reaches the sub oil chamber 52*h* in the second open valve 52*a*. The actuation valve ball 52*d* in the second actuation valve 52*b* is closed, and thus, the oil in the sub oil chamber 52*h* pushes the spool 52*c* toward the main oil chamber 52*g* side.

The second actuation valve 52*b* moves toward the main oil chamber 52*g* side to push the second check valve 52*e* open, allowing the pump-side second chamber-side channel 72B to communicate with the cylinder-side second chamber-side channel 72A leading from the second open valve 52*a* in the second channel-side channel 72 to the second chamber Y2 in the cylinder apparatus 10. Thus, the oil in the second chamber Y2, corresponding to a side pushed by the piston 12, is discharged into the second chamber-side channel 72, and returns to the gear pump 21 through the second chamber-side channel 72.

On the other hand, a flow of oil delivered from the gear pump 21 to the pump-side second chamber-side channel 723 as a result of backward rotation of the gear pump 21 is similar to the flow of oil in the case of the forward rotation of the gear pump 21. That is, oil flows into the main oil chamber 52*g* in the second open valve 52*a* to open the second check valve 52*e*. The oil then flows to the cylinder-side second chamber-side channel 72A and into the second chamber Y2 in the cylinder apparatus 10 to push the piston 12 toward the first chamber Y1.

Furthermore, the oil having flown into the main oil chamber 52*g* in the second open valve 52*a* opens the actuation valve ball 52*d* in the spool 52*c* in the second actuation valve 52*b* and then flows into the sub oil chamber 52*h*. Then, the oil passes through the communication path 51R and reaches the sub oil chamber 51*h* in the first open valve 51*a* to push the spool 51*c* in the first actuation valve 51*b* toward the main oil chamber 51*g* side. The pushed spool 51*c* pushes the first check valve 51*e* open to allow the cylinder-side first chamber-side channel 71A and the pump-side first chamber-side channel 71B to communicate with each other. The oil in the first chamber Y1, corresponding to a side pushed by the piston 12, is discharged into the first chamber-side channel 71, and returns to the gear pump 21 through the first chamber-side channel 71.

Thus, the first actuation valve 51*b* and the second actuation valve 52*b* are displaced under the pressure of oil from the gear pump 21, and thus have a function to open the second check valve 52*e* or the first check valve 51*e* in the direction of the displacement as a result of the displacement.

The first check valve 51*e* and the second check valve 52*e* have a function to return oil from the cylinder apparatus 10 when the first check valve 51*e* and the second check valve 52*e* are opened by the displacement of the second actuation valve 52*b* or the first actuation valve 51*b* and a function to supply oil to the cylinder apparatus 10 when the first check valve 51*e* and the second check valve 52*e* are opened by pressure acting on the first valve chamber 51*f* or the second valve chamber 52*f*.

(Up Blow Valve 53)

In this case, an up blow valve 53 (first chamber-side relief valve) is connected to the pump-side first chamber-side channel 71B. The up blow valve 53 is normally closed and opened when the pressure in the pump-side first chamber-side channel 71B becomes equal to or higher than a preset pressure, to let the oil in the pump-side first chamber-side channel 71B out to a first open channel 73 leading to the tank 80.

The pressure in the pump-side first chamber-side channel 71B becomes equal to or higher than the preset pressure, for example, in the following case. That is, even after oil is supplied to the first chamber Y1 in the cylinder apparatus 10 to extend the cylinder apparatus 10 to the limit of the range of extension, the gear pump 21 keeps rotating to continuously supply oil to the first chamber-side channel 71. In this case, the up blow valve 53 is opened to return the oil supplied to the pump-side first chamber-side channel 71B to the tank 80 through the first open channel 73.

(Down Blow Valve 54)

In this case, a down blow valve 54 (second chamber-side relief valve) is connected to the pump-side second chamber-side channel 72B. The down blow valve 54 is normally closed and opened when the pressure in the pump-side second chamber-side channel 72B becomes equal to or higher than a preset pressure, to let the oil in the pump-side second chamber-side channel 72B out to a second open channel 74 leading to the tank 80.

The pressure in the pump-side second chamber-side channel 72B becomes equal to or higher than the preset pressure, for example, in the following case. That is, the pressure in the second chamber-side channel 72 increases as a result of an increase in the volume of the piston rod 13 advancing into the second chamber Y2 when the cylinder apparatus 10 shortens, or even after oil is supplied to the second chamber Y2 in the cylinder apparatus 10 to shorten the cylinder apparatus 10 to the limit of the range of shortening, the gear pump 21 keeps rotating to continuously supply oil to the second chamber-side channel 72. In this case, the down blow valve 54 is opened to return the oil supplied to the pump-side second chamber-side channel 72B to the tank 80 through the second open channel 74.

When the cylinder apparatus 10 extends or shortens, the oil in the first chamber Y1 and the oil in the second chamber Y2 mostly simply circulate via the selector valve 51 and the gear pump 21. However, as described above, the total amount of the oil in the first chamber Y1 and the oil in the second chamber Y2 changes in accordance with the amount by which the piston rod 13 advances into the second chamber Y2. Thus, if the amount of oil delivered to the first chamber Y1 or the second chamber Y2 is insufficient, an amount of oil corresponding to the insufficiency is fed from the tank 80 to the gear pump 21 through a first supply channel 77 or a second supply channel 78 with check valves 57 or 58 provided therein. Whether the first supply channel 77 or the second supply channel 78 is used to feed oil from the tank 80 to the gear pump 21 depends on the direction of rotation of the gear pump 21.

(Third Relief Valve 55)

Furthermore, a third relief valve 55 (third chamber-side relief valve) is connected to the cylinder-side first chamber-side channel 71A. The third relief valve 55 is normally closed and opened when the pressure in the cylinder-side first chamber-side channel 71A becomes equal to or higher than a preset pressure (a pressure higher than the pressure at which the up blow valve 53 is opened), to let the oil in the cylinder-side first chamber-side channel 71A out to a third open channel 75 leading to the tank 80.

The pressure in the cylinder-side first chamber-side channel 71A becomes equal to or higher than the preset pressure, for example, in the following case. That is, a load such as impact which acts in a direction in which the extended cylinder apparatus 10 shortens or the temperature of the oil rises to increase the pressure in the cylinder-side first chamber-side channel 71A. In this case, the third relief valve 55 is opened to return the oil supplied to the cylinder-side first chamber-side channel 71A to the tank 80 via the third open channel 75.

The channel leading to the tank 80 is provided with a filter 83 to prevent foreign matter and the like mixed in the oil in the tank 80 from flowing into the above-described channels.

<Pump Apparatus 20>

Figure 6:
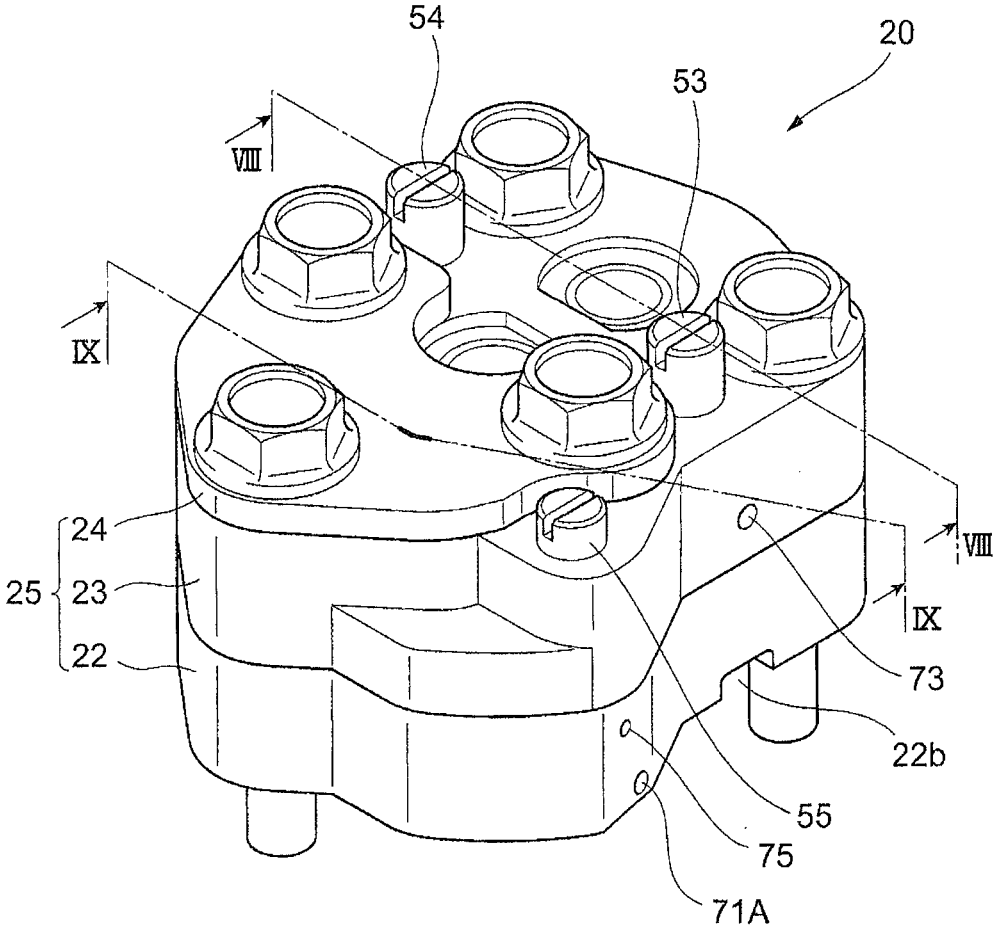
FIG. 6 is a diagram showing the appearance of the pump apparatus.
Figure 7:
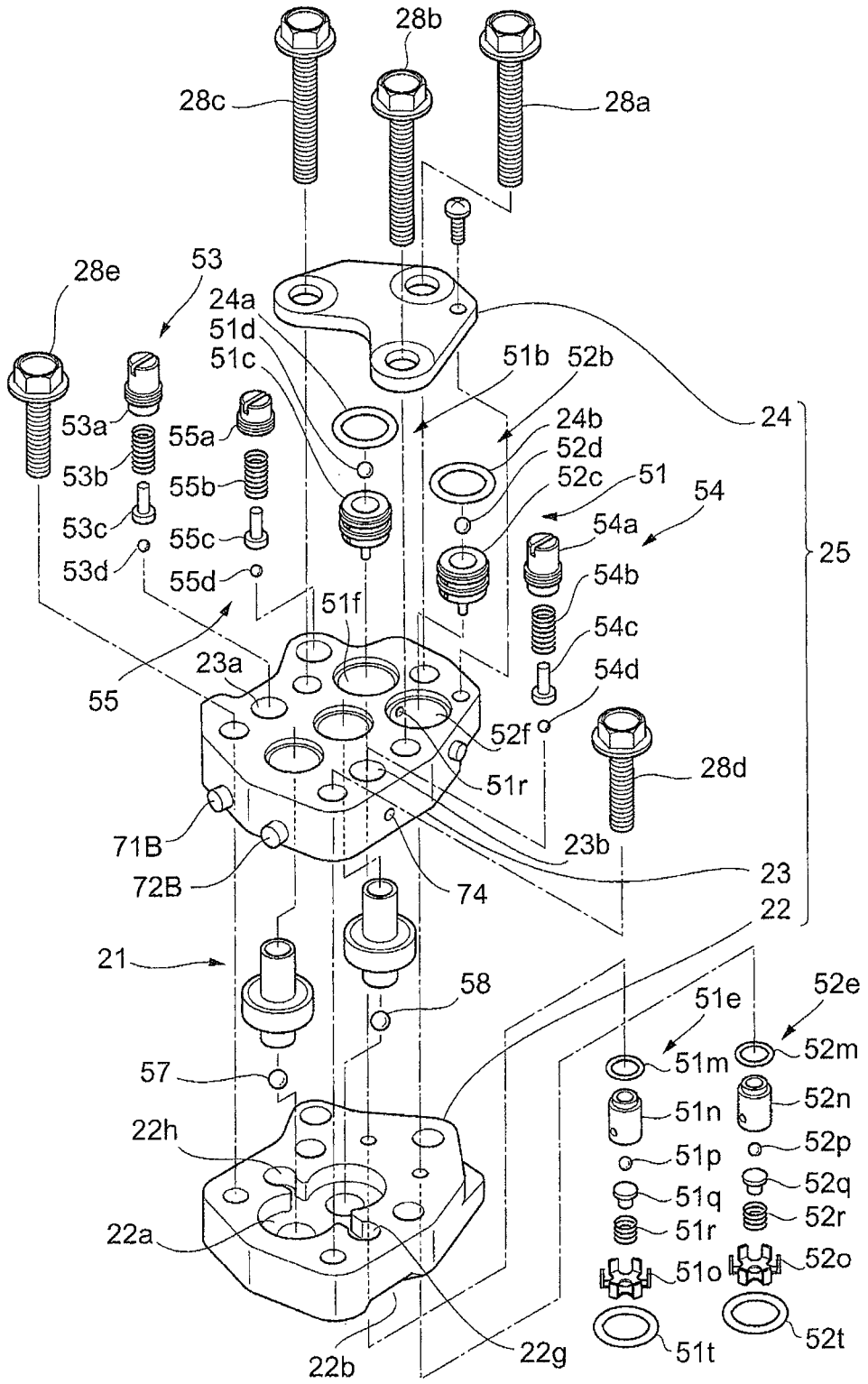
FIG. 7 is an exploded perspective view showing that the pump apparatus has been disassembled into components.
Figure 8:
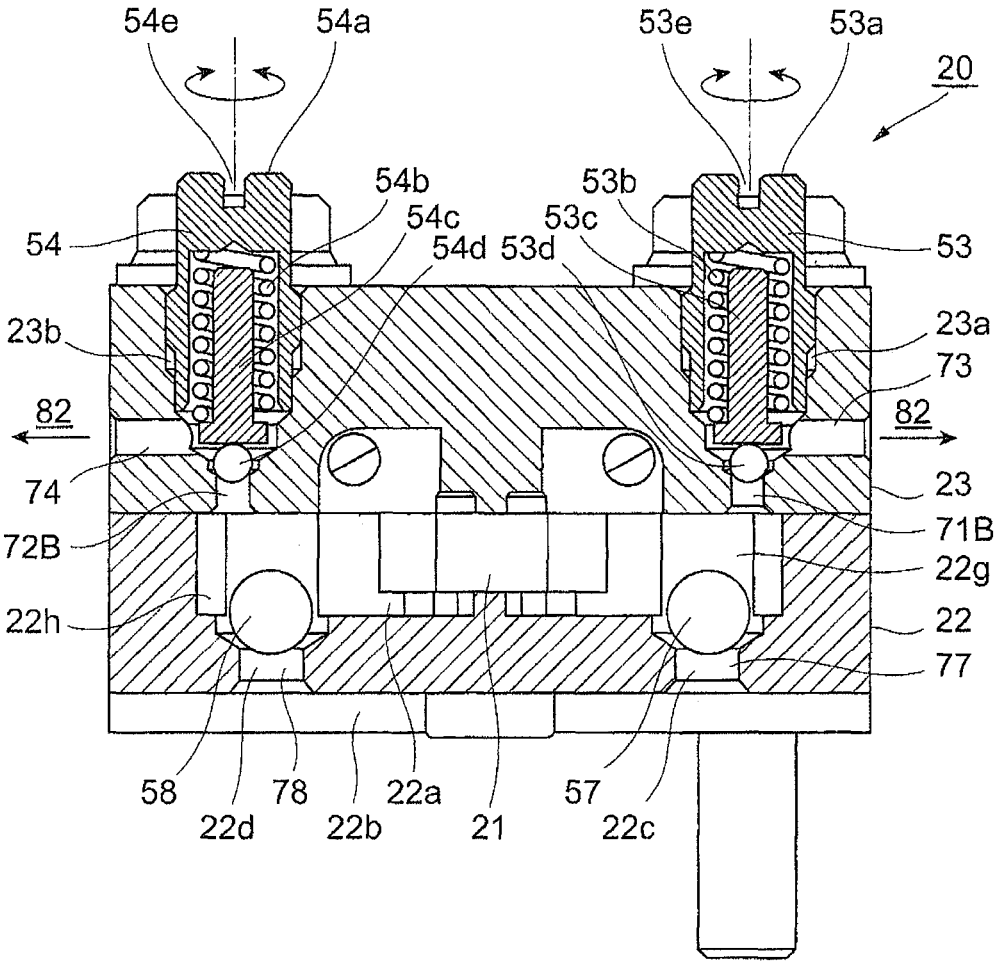
FIG. 8 is a cross-sectional view taken along a line VIII-VIII in FIG. 6 and showing a plane including an up blow valve and a down blow valve.

FIG. 6 is a diagram showing the appearance of the pump apparatus 20. FIG. 7 is an exploded perspective view showing that the pump apparatus 20 has been disassembled into components. FIG. 8 is a cross-sectional view showing a plane including the up blow valve 53 and the down blow valve 54. FIG. 9 is a cross-sectional view showing a plane including the first open valve 51*a* and second open valve 52*a* of the selector valve 51.

As shown in FIG. 7, the pump apparatus 20 includes a pump case 25, the gear pump 21, the selector valve 51, the up blow valve 53, the down blow valve 54, the third relief valve 55, and the two check valves 57 and 58. The pump case 25 has what is called a triple body structure in which a first case 22, a second case 23, and a cover plate 24 (cover member) are laid on top of one another in this order from the bottom of FIG. 7 and integrated together using five fastening members 28*a*, 28*b*, 28*c*, 28*d*, and 28*e*. Some of the five fastening members 28*a*, 28*b*, 28*c*, 28*d*, and 28*e* have a function to fix the pump apparatus 20 to the housing 81 (see FIG. 1).

In the pump apparatus 20, the gear pump 21 and the selector valve 51, up blow valve 53, down blow valve 54, third relief valve 55, and two check valves 57 and 58 used for the hydraulic circuit are housed inside the pump case 25 and integrated with the pump case 25 as shown in FIG. 6.

The first case 22 includes a groove 22*b* formed in a bottom surface of the first case 22. Furthermore, the first case 22 includes: a pump chamber 22*a* in which the gear pump 21 is housed; check valve chambers 22*g* and 22*h* in which the check valves 57 and 58 are housed; and a first check valve chamber 22*m* (see FIG. 9) and a second check valve chamber 22*n* in which the first check valve 51*e* and the second check valve 52*e* are housed.

The first check valve chamber 22*m* and the second check valve chamber 22*n* are formed to penetrate the first case 22 and the second case 23 in a direction in which the first case 22 and the second case 23 are laid on top of each other.

Furthermore, the second case 23 includes a first valve chamber 51*f* and a second valve chamber 52*f*. The first valve chamber 51*f* and the second valve chamber 52*f* are also each formed to penetrate the second case 23 in the direction of thickness of the second case 23. Furthermore, the second case 23 includes: an up blow valve chamber 23*a* in which the up blow valve 53 is housed; a down blow valve chamber 23*b* in which the down blow valve 54 is housed; and a third relief valve chamber 23*c* in which the third relief valve 55 is housed.

The cover plate 24 is, for example, an iron plate that closes openings 23*x* (see FIGS. 10A and 10B described below) of the first valve chamber 51*f* and the second valve chamber 52*f* formed in the second case 23.

As shown in FIG. 8, the gear pump 21 is arranged in the pump chamber 22*a*.

Furthermore, the up blow valve 53 is arranged in the up blow valve chamber 23*a*, and the down blow valve 54 is arranged in the down blow valve chamber 23*b*. The up blow valve 53 includes a valve ball 53*d* that opens and closes an area between the pump-side first chamber-side channel 71B leading to the check valve chamber 22*g* and the first open channel 73 leading to the tank chamber 82, a push pin 53*c* that comes into contact with the valve ball 53*d* from above, an adjustment screw 53*a* which is coaxial with the push pin 53*c* and which is coupled to the up blow valve chamber 23*a* in a threaded manner and which includes a top portion having a groove 53*e* for a tool formed in the top portion and projecting upward from the second case 23, and a coil spring 53*b* arranged between the push pin 53*c* and the adjustment screw 53*a* to exert, on the push pin 53*c*, an axial elastic force corresponding to the distance between the push pin 53*c* and the adjustment screw 53*a*.

In the up blow valve 53 configured as described above, the screwing-in depth of the adjustment screw 53*a* with respect to the second case 23 can be varied by inserting an easily available tool, for example, a flat-head screwdriver, into the groove 53*e* in the adjustment screw 53*a* projecting outward from the second case 23 and rotating the tool around the axis.

As the screwing-in depth of the adjustment screw 53*a* increases, the distance between the push pin 53*c* and the adjustment screw 53*a* decreases to increase the amount of initial compression of the coil spring 53*b* and thus the elastic force of the coil spring 53*b* pushing the push pin 53*c* downward. This in turn increases a load imposed on the pump-side first chamber-side channel 71B by the valve ball 53*d*, which is in contact with the push pin 53*c*, to close the pump-side first chamber-side channel 71B. This means an increase in a set value for the pressure in the pump-side first chamber-side channel 71B which is needed to shift to an operation of opening the closed up blow valve 53.

On the other hand, as the screwing-in depth of the adjustment screw 53*a* decreases, the distance between the push pin 53*c* and the adjustment screw 53*a* increases to reduce the amount of initial compression of the coil spring 53*b* and thus the elastic force of the coil spring 53*b* pushing the push pin 53*c* downward. This in turn reduces the load imposed on the pump-side first chamber-side channel 71B by the valve ball 53*d*, which is in contact with the push pin 53*c*, to close the pump-side first chamber-side channel 71B. This means a reduction in the set value for the pressure in the pump-side first chamber-side channel 71B which is needed to shift to an operation of opening the closed up blow valve 53.

As described above, the adjustment screw 53*a* of the up blow valve 53 serves as a pressure adjusting mechanism that adjusts the pressure (operating pressure) applied to actuate the up blow valve 53 (shift the up blow valve 53 from a closed state to an open state).

Like the up blow valve 53, the down blow valve 54 includes a valve ball 54*d* that opens and closes an area between the pump-side second chamber-side channel 72B leading to the check valve chamber 22*h* and the second open channel 74 leading to the tank chamber 82, a push pin 54*c* that comes into contact with the valve ball 54*d* from above, an adjustment screw 54*a* which is coaxial with the push pin 54*c* and which is coupled to the down blow valve chamber 23*b* in a threaded manner and which includes a top portion having a groove 54*e* for a tool formed in the top portion and projecting upward from the second case 23, and a coil spring 54*b* arranged between the push pin 54*c* and the adjustment screw 54*a* to exert, on the push pin 54*c*, an axial elastic force corresponding to the distance between the pushpin 54*c* and the adjustment screw 54*a*. Like the adjustment screw 53*a* of the up blow valve 53, the adjustment screw 54*a* of the down blow valve 54 serves as a pressure adjusting mechanism.

An adjusting action of the operating pressure of the down blow valve 54 is the same as the adjusting action taken by the up blow valve 53 and will thus not be described below.

The check valves 57 and 58 are arranged in the check valve chambers 22*g* and 22*h*, respectively, formed in the first case 22. The check valves 57 and 58 are placed in the check valve chambers 22*g* and 22*h*, respectively, during a step before the first case 22 and the second case 23 are laid on top of each other.

The check valve chambers 22*g* and 22*h* are in communication with holes 22*c* and 22*d*, respectively, extending downward. The holes 22*c* and 22*d* are formed to have an appropriate size at which the holes 22*c* and 22*d* are closed by the check valves 57 and 58, respectively, and are in communication with the groove 22*b* formed in a lower surface of the pump case 25. The pump apparatus 20 is immersed in the oil in the tank chamber 82. Thus, the groove 22*b* is filled with the oil, and the holes 22*c* and 22*d* correspond to the first supply channel 77 and the second supply channel 78, respectively, in the hydraulic circuit.

As shown in FIG. 9, the first actuation valve 51*b* and the second actuation valve 52*b* in the first open valve 51*a* and the second open valve 52*a*, respectively, of the selector valve 51 are arranged in a first valve chamber 51*f* and a second valve chamber 52*f*, respectively, formed in the second case 23. The first actuation valve 51*b* and the second actuation valve 52*b* are placed in the first valve chamber 51*f* and the second valve chamber 52*f*, respectively, during a step before the second case 23 and the cover plate 24 are laid on top of each other.

When the cover plate 24 is laid on top of and fixed to the second case 23 with the first actuation valve 51*b* placed in the first valve chamber 51*f* and with the second actuation valve 52*b* placed in the second valve chamber 52*f*, an upper surface of the first valve chamber 51*f* and an upper surface of the second valve chamber 52*f* are closed. At this time, O rings 24*a* and 24*b* are installed between the first valve chamber 51*f* and the cover plate 24 and between the second valve chamber 52*f* and the cover plate 24, respectively, to make the first valve chamber 51*f* and the second valve chamber 52*f* liquid-tight.

The first valve chamber 51*f* and the second valve chamber 52*f* are each formed to penetrate the second case 23 in the direction of thickness of the second case 23. Thus, the first actuation valve 51*b* and the second actuation valve 52*b*, housed in the first valve chamber 51*f* and the second valve chamber 52*f*, respectively, both slide along the direction in which the first case 22 and the second case 23 are laid on top of each other.

The second case 23 includes the communication path 51R and described above for the hydraulic circuit to connect the sub oil chamber 51*h* in the first valve chamber 51*f* to the sub oil chamber 51*h* in the second valve chamber 52*f*.

Figure 10B:
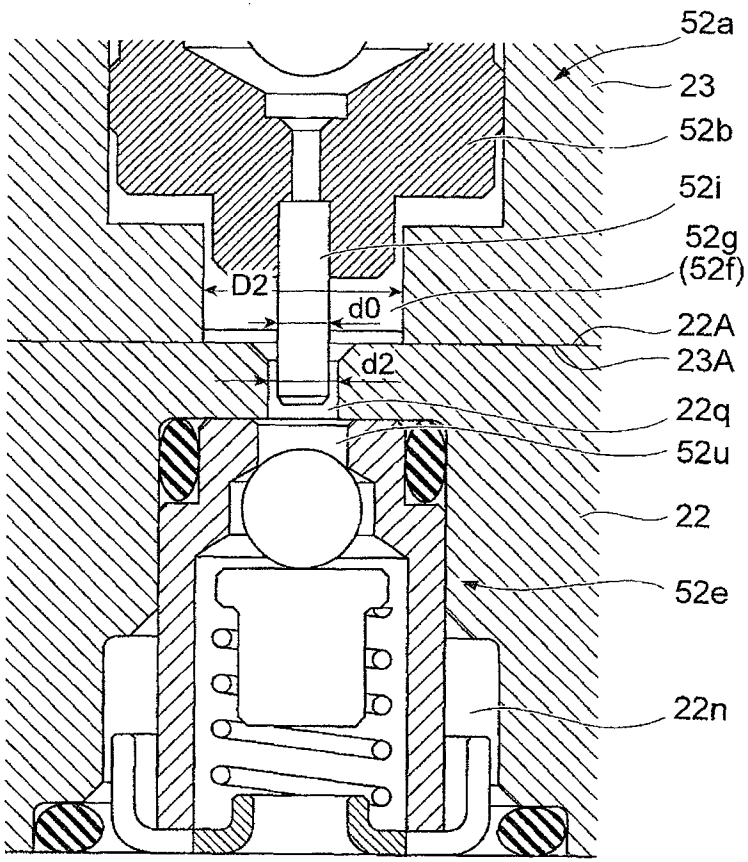
FIG. 10B is a cross-sectional view showing an opening portion of a second check valve chamber.
Figure 10A:
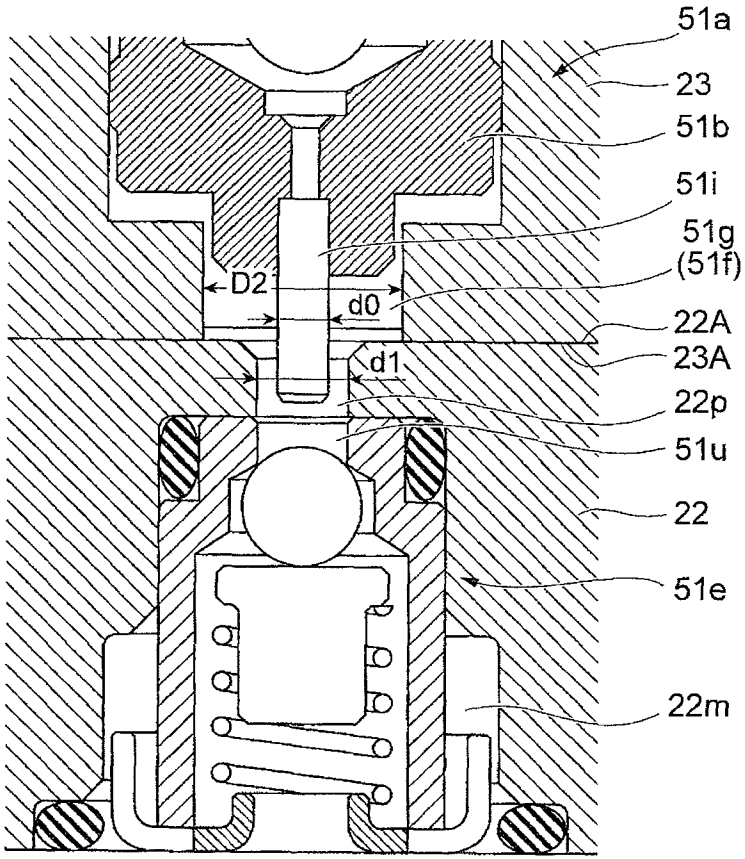
FIG. 10A is a cross-sectional view showing an opening portion of a first check valve chamber.

A portion of the main oil chamber 51*g* in the first valve chamber 51*f* which faces the first case 22 is formed to have an inner diameter D2, and a portion of the main oil chamber 52*g* in the second valve chamber 52*f* which faces the first case 22 is also formed to have the inner diameter D2, as shown in FIGS. 10A and 103, described below.

The first check valve chamber 22*m*, formed in the first case 22, is formed in an area opposite to the first valve chamber 51*f* when the first case 22 and the second case 23 are laid on top of each other. Furthermore, the second check valve chamber 22*n*, formed in the first case 22, is formed in an area opposite to the second valve chamber 52*f* when the first case 22 and the second case 23 are laid on top of each other.

FIG. 10A is a cross-sectional view showing the details of the first check valve chamber 22*m*. FIG. 10B is a cross-sectional view showing the details of the second check valve chamber 22*n*. As described above, the first check valve chamber 22*m* and the second check valve chamber 22*n* are formed to penetrate the first case 22 in the direction of thickness of the first case 22.

As shown in FIG. 10A, a portion 22*p* (hereinafter referred to as an opening portion 22*p*) of the first check valve chamber 22*m* which is open on a side where the first check valve chamber 22*m* faces the second case 23 faces the main oil chamber 51*g* in the first valve chamber 51*f*, formed in the second case 23. Thus, the opening portion 22*p* is configured as a part of a channel between the first actuation valve 51*b* and the first check valve 51*e*. The opening portion 22*p* is also a part of the first chamber-side channel 71 (see FIG. 5) in the first open valve 51*a*.

As shown in FIG. 10B, a portion 22*q* (hereinafter referred to as an opening portion 22*q*) of the second check valve chamber 22*n* which is open on a side of the second check valve chamber 22*n* facing the second case 23 faces the main oil chamber 52*g* in the second valve chamber 52*f*, formed in the second case 23. Thus, the opening portion 22*q* is configured as a part of a channel between the second actuation valve 52*b* and the second check valve 52*e*. The opening portion 22*q* is also a part of the second chamber-side channel 72 (see FIG. 5) in the second open valve 52*a*.

In this case, the opening portion 22*p* of the first check valve chamber 22*m* is formed to have a diameter d1 which is smaller than the inner diameter D2 of the portion of the main oil chamber 51*g* in the first valve chamber 51*f* facing the first case 22 and which is larger than the diameter d0 of the projection 51*i* provided in the first actuation valve 51*b* and which pushes the first check valve 51*e* (d0<d1<D2).

On the other hand, the opening portion 22*q* of the second check valve chamber 22*n* is formed to have a diameter d2 which is smaller than the inner diameter D2 of the portion of the main oil chamber 52*g* in the second valve chamber 52*f* facing the first case 22 and which is larger than the diameter d0 of the projection 52*i* provided in the second actuation valve 52*b* and which pushes the second check valve 52*e* (d0<d2<D2).

Moreover, the diameter d2 of the opening portion 22*q* of the second check valve chamber 22*n* is smaller than the diameter d1 of the opening portion 22*p* of the first check valve chamber 22*m* (d2<d1).

As shown in FIG. 9, the first check valve 51*e* includes an O ring 51*m*, a valve case 51*n*, a valve ball 51*p*, a push pin 51*q*, a coil spring 51*r*, a spring presser 51*o*, and an O ring 51*t*.

The valve case 51*n* is fitted in the first check valve chamber 22*m* via the O ring 51*m*. The valve case 51*n* includes a small hole 51*u* formed at a top portion of the valve case 51*n* and through which the opposite projection 51*i* of the first actuation valve 51*b* is passed. The small hole 51*u* has a diameter equal to the diameter d1 of the opening portion 22*p* of the first check valve chamber 22*m*.

The valve ball 51*p*, the push pin 51*q*, and the coil spring 51*r* are arranged in a case internal chamber 51*s* formed inside the valve case 51*n*.

The valve ball 51*p* is formed to be large enough to close the small hole 51*u* formed in the valve case 51*n*. The push pin 51*q* is arranged below the valve ball 51*p* so that the valve ball 51*p* comes into contact with an upper surface of the push pin 51*q*. The spring presser 51*o* is fitted at a bottom portion of the first check valve chamber 22*m* to support the valve case 51*n* from below. The O ring 51*t* is arranged around the spring presser 51*o*. The coil spring 51*r* is arranged between the push pin 51*q* and the spring presser 51*o* to exert an axial elastic force on the push pin 51*q*.

When the pump apparatus 20 is fixed to the housing 81 as shown in FIG. 2, an opening 22*e* formed in a central portion of the spring presser 51*o* allows the case internal chamber 51*s* to communicate with the housing first hole 81*a* formed in the housing 81. In this case, the O ring 51*t* ensures light-tightness between the tank chamber 82 and both the case internal chamber 51*s* and the housing first hole 81*a*.

In the first check valve 51*e* configured as described above, the push pin 51*q* lifted up by the elastic force of the coil spring 51*r* pushes the valve ball 51*p* upward, and the valve ball 51*p* closes the small hole 51*u* in the valve case 51*n*. This in turn closes an area between the main oil chamber 51*g* in the first actuation valve 51*b* and the case internal chamber 51*s* in the first check valve 51*e*.

At this time, when oil is supplied to the main oil chamber 51*g* in the first actuation valve 51*b* to raise the pressure in the main oil chamber 51*g*, the pressure in the main oil chamber 51*g* acts on the valve ball 51*p* through the small hole 51*u* to push the valve ball 51*p* downward against the elastic force of the coil spring 51*r*. This brings the main oil chamber 51*g* and the case internal chamber 51*s* into communication with each other to feed the oil in the main oil chamber 51*g* to the housing first hole 81*a* through the case internal chamber 51*s*.

Furthermore, when the oil is fed to the main oil chamber 52*g* in the second actuation valve 52*b* to raise the pressure in the main oil chamber 52*g*, the oil in the main oil chamber 52*g* flows through the second hole 52*k* in the spool 52*c* and then through the sub oil chamber 52*h*, the first hole 52*j*, and the communication path 51R in this order. The oil further flows into the sub oil chamber 51*h* in the first actuation valve 51*b* through the first hole 51*j* in the first actuation valve 51*b*.

The pressure in the sub oil chamber 51*h* in the first actuation valve 51*b* rises to cause the actuation valve ball 51*d* to block the communication between the sub oil chamber 51*h* and the main oil chamber 51*g*. Thus, the spool 51*c* in the first actuation valve 51*b* moves toward the main oil chamber 51*g* side. The movement of the spool 51*c* causes the projection 51*i* provided on the spool 51*c* to act on the valve ball 51*p* to push the valve ball 51*p* downward against the elastic force of the coil spring 51*r*. This brings the main oil chamber 51*g* and the case internal chamber 51*s* into communication with each other to return the oil having returned to the case internal chamber 51*s* through the housing first hole 81*a*, to the main oil chamber 51*g*.

The second check valve 52*e* housed in the second check valve chamber 22*n* is configured similarly to the first check valve 51*e*. The second check valve 52*e* includes an O ring 52*m*, a valve case 52*n*, a valve ball 52*p*, a push pin 52*q*, a coil spring 52*r*, a spring presser 52*o*, and an O ring 52*t*.

The valve case 52*n* includes a small hole 52*u*, which is formed at a top portion of the valve case 52*n* and through which the projection 52*i*, on the opposite side of the valve case 52*n*, of the second actuation valve 52*b* is passed. The small hole 52*u* has the same size as that of the small hole 51*u* in the valve case 51*n* in the first check valve 51*e*.

Action of the second check valve 52*e* is the same as the action of the first check valve 51*e* and will thus not be described.

With the pump apparatus 20 fixed to the housing 81 (see FIG. 2), the opening 22*f* formed in a central portion of the spring presser 52*o* allows the case internal chamber 52*s* and the housing fourth hole 81*f* formed in the housing 81 to communicate with each other. At this time, the O ring 52*t* ensures light-tightness between the tank chamber 82 and both the case internal chamber 52*s* and the housing fourth hole 81*f*.

The third relief valve 55 is arranged across the first case 22 and the second case 23. Like the up blow valve 53 and the down blow valve 54, the third relief valve 55 includes a valve ball 55*d* that opens and closes an area between the third open channel 75 and the cylinder-side first chamber-side channel 71A leading to the case internal chamber 51*s* in the first check valve 51*e*, the push pin 55*c* that comes into contact with the valve ball 55*d* from above, an adjustment screw 55*a* which is coaxial with the push pin 55*c* and which is coupled to the second case 23 in a threaded manner and which includes a top portion having a thread groove 55*e* in the top portion and projecting upward from the second case 23, and a coil spring 55*b* arranged between the pushpin 55*c* and the adjustment screw 55*a* to exert, on the pushpin 55*c*, an axial elastic force corresponding to the distance between the push pin 55*c* and the adjustment screw 55*a*. Like the adjustment screw 53*a* of the up blow valve 53, the adjustment screw 55*a* of the third relief valve 55 serves as a pressure adjusting mechanism.

An adjusting action of the operating pressure of the third relief valve 55 is the same as the adjusting action taken by the up blow valve 53 or the down blow valve 54 and will thus not be described below.

<Action and Effects of the Pump Apparatus 20>

In the pump apparatus 20 and trim/tilt apparatus 100 according to Embodiment 1 configured as described above, the diameter d2 of the opening portion 22*q* of the second check valve chamber 22*n* is smaller than the inner diameter D2 of the main oil chamber 52*g* in the second valve chamber 52*f* as shown in FIG. 10B. Thus, the opening portion 22*q* functions as the narrowed orifice in the second chamber-side channel 72.

In this case, the orifice is formed to set, during the stroke of the piston for shortening the cylinder apparatus, the pressure in a portion of the second chamber-side channel 72 closer to the gear pump 21 than the orifice (the pump-side second chamber-side channel 72B) higher than the pressure in a portion of the second chamber-side channel 72 closer to the cylinder apparatus 10 than the orifice (the cylinder-side second chamber-side channel 72A).

In other words, the opening portion 22*q* of the second check valve chamber 22*n* functions as a orifice that suppresses jerky motion of the cylinder apparatus 10 when the cylinder apparatus 10 is shortened. The pump apparatus 20 and the trim/tilt apparatus 100 according to Embodiment 1 allows jerky motion of the cylinder apparatus 10 to be suppressed when the cylinder apparatus 10 is shortened.

The pump apparatus 20 and the trim/tilt apparatus 100 according to Embodiment 1 eliminates the need to form, independently of the housing 81 and the cylinder 11, an orifice that suppresses jerky motion of the cylinder apparatus 10 when the cylinder apparatus 10 is shortened.

In this case, the opening portion 22*q* of the second check valve chamber 22*n*, functioning as an orifice, is a portion existing as a channel through which the main oil chamber 52*g* in the second valve chamber 52*f* communicates with the second check valve chamber 22*n*. Thus, during a machining operation for forming the opening portion 22*q*, by merely reducing the diameter of the opening portion 22*q*, the opening portion 22*q* can be provided with a function as the narrowed orifice. This eliminates the need for an additional machining operation for forming a narrowed orifice.

Therefore, the pump apparatus 20 and the trim/tilt apparatus 100 according to Embodiment 1 eliminate the need for a machining operation for forming a narrowed orifice, enabling a reduction in machining man-hour.

Furthermore, in the pump apparatus 20 and the trim/tilt apparatus 100 according to Embodiment 1, the second check valve chamber 22*n* is formed in the first case 22, the second valve chamber 52*f* is formed in the second case 23, and the first case 22 and the second case 23 are laid on top of each other. The opening portion 22*q* of the second check valve chamber 22*n*, functioning as a narrowed orifice, can be formed by machining the surface 22A on which the second case 23 is laid. Consequently, the opening portion 22*q* can be formed using an easy machining operation.

In the pump apparatus 20 and the trim/tilt apparatus 100 according to Embodiment 1, the opening portion 22*p* of the first check valve chamber 22*m* also has the diameter d1 smaller than the inner diameter D2 of the main oil chamber 51*g* in the first valve chamber 51*f* and can thus function as a narrowed orifice in the first chamber-side channel 71. However, for the pump apparatus and the hydraulic actuator according to the present invention, the provision of a narrowed orifice in the first chamber-side channel 71 is not essential. Thus, also in the pump apparatus 20 and the trim/tilt apparatus 100 according to Embodiment 1, the opening portion 22*p* of the first check valve chamber 22*m* need not be formed to have a smaller diameter than the main oil chamber 51*g* in the first valve chamber 51*f*.

In Embodiment 1, the opening portion 22*q* of the second check valve chamber 22*n* has a smaller channel area than the opening portion 22*p* of the first check valve chamber 22*m* and thus exerts a higher orifice effect (a higher effect as a narrowed orifice) than the opening portion 22*p* of the first check valve chamber 22*m*. Therefore, even if the opening portion 22*p* of the first check valve chamber 22*m* fails to exhibit a high orifice effect, the opening portion 22*q* of the second check valve chamber 22*n* can be allowed to demonstrate a relatively high orifice effect. This enables jerky motion of the cylinder apparatus 10 to be suppressed when the cylinder apparatus 10 is shortened.

Furthermore, the pump apparatus 20 and the trim/tilt apparatus 100 according to Embodiment 1 integrally include the selector valve 51, the up blow valve 53, the down blow valve 54, the third relief valve 55, the check valves 57 and 58, and the opening portion 22*q* of the second check valve chamber 22*n*, serving as a orifice, all of which are included in the hydraulic circuit connected to the cylinder apparatus 10.

Therefore, when the pump apparatus 20 has not been assembled to the cylinder apparatus 10 yet and is thus independent of the cylinder apparatus 10, it is possible to measure, in a step of measuring the performance of the gear pump 21 such as oil pumping capability, the hydraulic circuit as a whole incorporating the selector valve 51, the up blow valve 53, the down blow valve 54, the third relief valve 55, the check valves 57 and 58, and the opening portion 22*q* of the second check valve chamber 22*n*, serving as a orifice.

This enables a reduction in man-hour for performance measurements for the pump apparatus 20 and the hydraulic circuit.

Furthermore, since the pump apparatus 20 integrally includes the selector valve 51, the up blow valve 53, the down blow valve 54, the third relief valve 55, the check valves 57 and 58, and the opening portion 22*q* of the second check valve chamber 22*n*, serving as a orifice, all of which belong to the hydraulic circuit, none of the valves and orifices of the hydraulic circuit is arranged in the housing 81.

Therefore, the housing 81 according to Embodiment 1 allows the channels formed in the housing 81 (cylinder-side first chamber-side channel 71A and cylinder-side second chamber-side channel 72A) to be simplified compared to a housing in a conventional trim/tilt apparatus in which valves and orifices are arranged. This enables a reduction in portions of the channels formed in the housing 81 (cylinder-side first chamber-side channel 71A and cylinder-side second chamber-side channel 72A) which are joined together by crossing of holes providing the channels.

In the portions where the holes cross each other, burrs resulting from drilling of holes are likely to remain. The reduction in the portions where the holes cross each other allows burrs to be unlikely to remain in the channels.

The pump apparatus and the hydraulic actuator according to the present invention is not limited to the form in which the pump apparatus 20 integrally includes the selector valve 51, the up blow valve 53, the down blow valve 54, the third relief valve 55, the check valves 57 and 58, and the opening portion 22*q* of the second check valve chamber 22*n*, serving as a orifice, all of which belong to the hydraulic circuit to control the oil pressure. The valves other than the selector valve 51 may be separated from the pump apparatus 20 and provided, for example, in the housing 81.

Embodiment 2

In the pump apparatus 20 and the trim/tilt apparatus 100 according to Embodiment 1, the opening portion 22*q* of the second check valve chamber 22*n* in the first case 22 is formed as a orifice. However, the present invention is not limited this form.

Figure 11B:
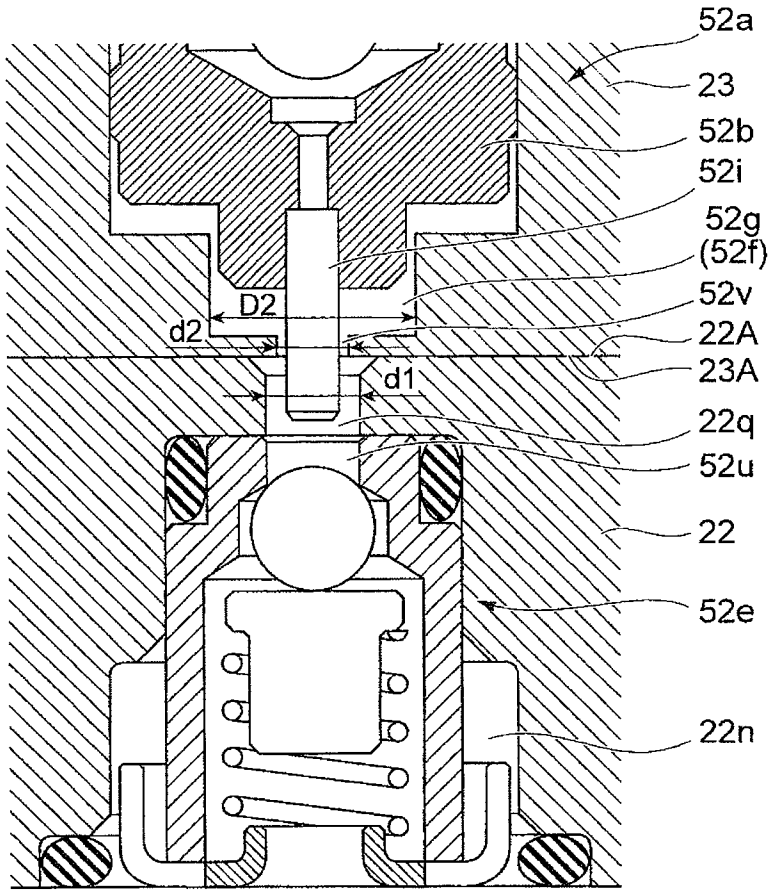
FIG. 11B is a cross-sectional view showing an opening portion of a second check valve chamber in the pump apparatus and the trim/tilt apparatus according to Embodiment 2.
Figure 11A:
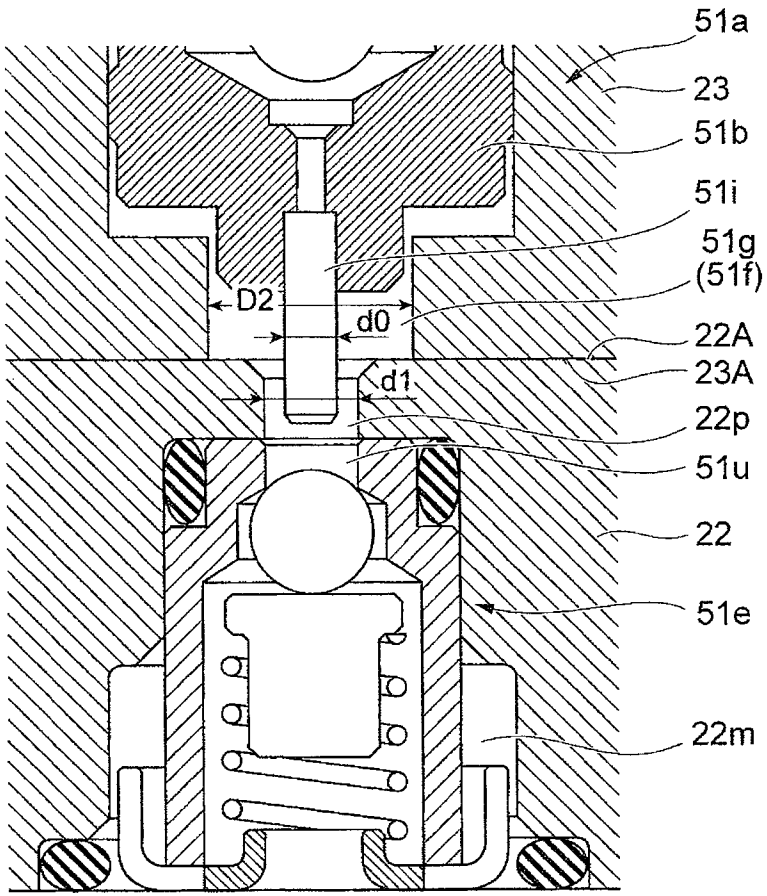
FIG. 11A is a cross-sectional view showing an opening portion of a first check valve chamber in a pump apparatus and a trim/tilt apparatus according to Embodiment 2.

FIG. 11A is a cross-sectional view showing a portion of the first valve chamber 51*f* in the pump apparatus 20 and trim/tilt apparatus 100 according to another embodiment (Embodiment 2) of the present invention which portion leads to the first check valve 51*e*, and FIG. 11B is a cross-sectional view showing a portion of the second valve chamber 52*f* in the pump apparatus 20 and trim/tilt apparatus 100 according to Embodiment 2 which portion leads to the second check valve 52*e*. Embodiment 2 is an example in which, instead of a orifice formed in the second check valve chamber 22*n* in the first case 22, a orifice in the second chamber-side channel 72 is obtained by forming a portion 52*v* (which leads to the second check valve 52*e*) of the main oil chamber 52*g* in the second valve chamber 52*f* formed in the second case 23 which portion lies opposite the opening portion 22*q* in the second check valve chamber 22*n* so that the portion 52*v* has the diameter d2, for example, as shown in FIG. 11B.

In this case, the opening portion 22*q* of the second check valve chamber 22*n* may have the same diameter d1 as that of the opening portion 22*p* of the first check valve chamber 22*m* shown in FIG. 11A.

The pump apparatus 20 and the trim/tilt apparatus 100 according to Embodiment 2 configured as described above can exert the same effects as those of Embodiment 1.

In the pump apparatus 20 and the trim/tilt apparatus 100 according to Embodiments 1 and 2, the two relief valves, that is, the up blow valve 53 and the third relief valve 55, are provided in the first chamber-side channel 71 leading to the first chamber Y1 in the cylinder apparatus 10, as shown in FIG. 5. However, the pump apparatus and the hydraulic actuator according to the present invention are not limited to this form.

Furthermore, Embodiments 1 and 2 are applied to the trim/tilt apparatus as an example of the hydraulic actuator. However, the hydraulic actuator according to the present invention is not limited to these trim/tilt apparatuses.

What is claimed is:

1. A pump apparatus for supplying a hydraulic fluid to a cylinder apparatus which is partitioned by a piston into a first chamber and a second chamber, the first chamber extending during an extending stroke of the cylinder apparatus, and the second chamber extending during a shortening stroke of the cylinder apparatus, said pump apparatus integrally comprising:

a pump that ejects the hydraulic fluid;

a selector valve that switches a direction of a flow of the hydraulic fluid to be supplied to one of the first chamber and the second chamber, the selector valve containing an actuation valve, a check valve, a first orifice and a second orifice, wherein the second orifice is provided at a second chamber-side channel, which is connected to the second chamber, said second orifice being narrower than the first orifice provided at a first chamber-side channel, which is connected to the first chamber, the second orifice is fluidly located between the actuation valve and the check valve, and the second orifice is configured to set a pressure in a portion of the second chamber-side channel closer to the pump than the second orifice higher than a pressure in a portion of the second chamber-side channel closer to the cylinder apparatus than the second orifice during the shortening stroke.

2. The pump apparatus according to claim 1, wherein the second orifice is formed as a part of a channel between the actuation valve and the check valve.

3. The pump apparatus according to claim 2, further comprising a case that houses the pump, wherein the case includes a first case and a second case, which is laid on the first case, the first case comprises a check valve chamber in which a main body of the check valve is housed, and the second case comprises an actuation valve chamber in which a main body of the actuation valve is housed.

4. A hydraulic actuator comprising:

a cylinder apparatus internally partitioned by a piston into a first chamber extending during an extending stroke of the cylinder apparatus and a second chamber extending during a shortening stroke of the cylinder apparatus;

a pump apparatus integrally comprising a pump that ejects a hydraulic fluid and a selector valve that switches a direction of a flow of the hydraulic fluid to be supplied to one of the first chamber and the second chamber; and a case that houses the pump and includes a first case and a second case which is laid on the first case, wherein the selector valve has a second orifice formed as part of a second chamber-side channel, which is connected to the second chamber, said second orifice being narrower than a first orifice provided at a first chamber-side channel, which is connected to the first chamber, the selector valve has an actuation valve and a check valve, and the second orifice is formed as a part of the second chamber-side channel provided in the first case and is narrower than the first orifice provided at the first chamber-side channel provided in the first case, the second orifice is fluidly located between the actuation valve and the check valve, and the second orifice is configured to set a pressure in a portion of the second chamber-side channel closer to the pump than the second orifice higher than a pressure in a portion of the second chamber-side channel closer to the cylinder apparatus than the second orifice during the shortening stroke.

5. The pump apparatus according to claim 1, wherein the actuation valve has a projection in an axial direction, and the second orifice is configured to receive the projection.

* * * * *